US005685043A

United States Patent [19]

LaManna et al.

[11] Patent Number: 5,685,043

[45] Date of Patent: Nov. 11, 1997

[54] REMOVAL OF PARTICULATES FROM CYLINDRICAL MEMBERS

[75] Inventors: Gina M. LaManna, Ontario; Gary W. Smallman, Fairport; David J. Kilmer, Ontario; Richard C. Petralia, Rochester; Patrick R. Shane, East Rochester, all of N.Y.

[73] Assignee: Xerox Corporation, Stamford

[21] Appl. No.: 505,932

[22] Filed: Jul. 24, 1995

[51] Int. Cl.[6] ..... G03G 21/00; B08B 1/04

[52] U.S. Cl. ..... 15/256.52; 15/256.51; 15/256.5; 399/343; 399/345; 399/357; 399/358; 399/352

[58] Field of Search ..... 15/256.51, 256.52, 15/256.53, 104.002, 3, 1.51; 399/343, 345, 357, 358, 352, 347; 101/425; 118/652, 70; 432/75

[56] References Cited

U.S. PATENT DOCUMENTS

| | | | |
|---|---|---|---|
| 2,937,390 | 5/1960 | Bolton et al. | 15/3 |
| 3,861,860 | 1/1975 | Thettu et al. | 15/256.52 |
| 3,861,861 | 1/1975 | Thettu | 15/256.52 |
| 3,883,292 | 5/1975 | Hamaker | 15/256.52 |
| 3,883,921 | 5/1975 | Thettu et al. | 15/256.52 |
| 4,009,047 | 2/1977 | Lindsay | 15/3 |
| 4,018,555 | 4/1977 | Thettu | 15/256.52 |
| 4,982,469 | 1/1991 | Nishinaki | 15/3 |
| 5,251,348 | 10/1993 | Corrado et al. | 15/256.53 |
| 5,275,104 | 1/1994 | Corrado et al. | 101/425 |
| 5,483,717 | 1/1996 | Chikaki | 15/3 |

*Primary Examiner*—Gary K. Graham

[57] ABSTRACT

A system in which a contact cleaning cylinder is brought into moving synchronous contact with the surface of a cylindrical member to be cleaned to clean the surface.

10 Claims, 2 Drawing Sheets

REMOVAL OF PARTICULATES FROM CYLINDRICAL MEMBERS

BACKGROUND OF THE INVENTION

This invention relates in general to the cylindrical members and more specifically, to an apparatus and process for cleaning cylindrical members.

In the art of electrophotography an electrophotographic plate comprising a photoconductive insulating layer on a conductive layer is imaged by first uniformly electrostatically charging the imaging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

The flexible belts are usually multilayered photoreceptors that comprise a substrate, a conductive layer, an optional hole blocking layer, an optional adhesive layer, a charge generating layer, and a charge transport layer and, in some embodiments, an anti-curl backing layer.

Although excellent toner images may be obtained with multilayered belt photoreceptors, it has been found that as more advanced, higher speed electrophotographic copiers, duplicators and printers were developed, the electrical and mechanical performance requirements have become more demanding. It has also been found that these electrical and mechanical performance requirements are not being met because of defects in one or more of the coated layers of the multilayered belt photoreceptors. These defects are caused by the presence of dirt particles on the substrate, conductive layer, optional hole blocking layer, optional adhesive layer, charge generating layer, charge transport layer and/or optional anti-curl backing layer. Thus for example, particles of dirt (particulate debris) residing on an uncoated or coated substrate surface during application of coatings to form an electrostatographic imaging member, such as a photoreceptor, can cause bubbles or voids to form in the various applied coating layers. It is believed that the dirt particles behave in a manner similar to a boiling chip which initiates solvent boiling at the location of the particle. This local boiling problem is aggravated when a coating solution is maintained near the boiling point of the coating solvent during deposition of the coating or during drying. The formation of bubbles in a coating is particularly acute in photoreceptor charge generation layer coatings and in charge transport layer coatings. Also, dirt particles tend to trap air during application of a coating and the trapped air expands during drying to form an undesirable bubble in the coating.

Further, any dirt particles residing on one or both major surfaces of an electrophotographic imaging member web substrate can adversely affect adjacent surfaces when the web is rolled up into a roll because the dirt particles cause impressions on the adjacent web surfaces. Because these undesirable impressions can be repeated through more than one overlapping web layer, large sections of a coated web must be scrapped. Where large belts, e.g. ten pitch belts, are to be fabricated, a 10 percent defect rate for a single pitch can result in the discarding of 60 to 70 percent of the entire web because very large expanses of defect free surfaces are required for such large belts.

The sources of the dirt particles include transporting systems, coating systems, drying systems, cooling slitting systems, winding systems, unwinding systems, debris from the electrophotographic imaging member web substrate itself, workers, and the like.

In relatively thin charge blocking layers, such as organopolysiloxane layers applied with a gravure coater, any dirt particles present on the web surface tends to lift the coating layer and cause local coating voids. This also occurs with relatively thin adhesive layers between a charge blocking layer and a charge generation layer. Usually, after a web substrate is coated with the charge blocking layer and adhesive layer, the coated web substrate is rolled up into a roll and transported to another coating station. During unrolling or unwinding of the coated web, static electricity is generated as the outermost ply of the coated web is separated from the roll. This static electricity tends to attract dirt particles to the exposed surfaces of the web.

It has been found that brushing, buffing or other cleaning systems which physically contact the delicate and fragile surfaces of a coated or uncoated electrophotographic imaging member web substrate can cause undesirable scratches in the delicate outer surface of the substrate even if the contact systems are employed in conjunction with electrostatic discharge bars. Cleaning systems that do not contact the coated or uncoated electrophotographic imaging member web substrate, such as air knives and vacuum systems, whether or not assisted with electrostatic discharge bars, are not capable of removing small particles, those having an average particle size of less than about 100 micrometers to 30 micrometers range due to electrostatic attraction and a thin protective inertial air boundary layer on the substrate surface.

The use of a contact cleaner roll making continuous rolling contact with a moving web can remove loose particles of contamination from the web. As the web moves over the cleaner roll, the loose particulate matter is transferred from the web to the cleaner roll which is somewhat adhesive or tacky. As this transfer process continues, the transferred contaminants accumulate on the surface of the cleaner roll. The cleaner roll itself becomes contaminated and is replaced or cleaned periodically to restore its effectiveness. This is typically done by shutting down the system or process, retracting the cleaner roll, and washing and drying it manually. To avoid down time of the system or process, these contact cleaner rolls can be cleaned without interrupting the continuous movement of web through the apparatus by a device for sequential cleaning of the contact cleaner rolls. This type of contact cleaner roll system is disclosed, for example, in U.S. Pat. No. 5,251,348, the disclosure thereof being incorporated herein in its entirety.

When liquid cleaners are utilized to clean a cleaning roll, some liquid cleaners can leave an undesirable residue on cleaned cleaning roll which can subsequently be transferred to an electrostatographic imaging member during a cleaning step. Many foreign materials deposited on any of the various layers of an electrostatographic imaging member during fabrication thereof can adversely affect the electrical and physical properties of the final fabricated imaging member.

Similar residue problems are encountered when cleaning drum substrates for electrostatographic imaging members. Further, when very large diameter substrates for electrostatographic imaging members are washed with liquid cleaners excessively large volumes of expensive liquid cleaners and rinse liquids are required. Moreover, the large amount of resulting waste liquids present a challenging disposal problem.

INFORMATION DISCLOSURE STATEMENT

U.S. Pat. No. 5,251,348 to Corrado et al, issued Oct. 12, 1993—A contact cleaner roll cleaning system is described which includes a frame supporting the system relative to a moving web, a contact cleaner roll turret on the frame, and a roll cleaner on the frame. The turret supports two or more rotatable contact cleaner rolls, an active roll in rolling contact with the web, and an idle roll out of contact with the web for cleaning. The idle roll is kept rotating while it is idle and being cleaned. The turret is rotatable to sequentially put the cleaner rolls into and out of contact with the web. The roll cleaner includes an absorbent cleaning material mounted adjacent to the idle roll for placement against it and movement lengthwise along it to wipe it clean. Spindles advance the cleaning material between wipings of the idle roll, and a liquid delivery system keeps the cleaning material wet.

U.S. Pat. No. 5,275,104 to Corrado et al, issued Jan. 4, 1994—A Apparatus is disclosed for cleaning a rotating process roll includes cleaning material supply and take-up rolls and a compliant touch roll, all mounted on a carriage adjacent to a process roll. Touch roll and cleaning material are movable by air cylinders into and out of contact with the process roll. The touch roll is rotatable in one direction only with the take-up roll. A drive motor winds the take-up roll to incrementally and uniformly advance the cleaning material over the touch roll. Period and frequency of the cleaning cycle and sub-cycles are variable by microprocessor control. Supply roll and take-up roll are supported in retractable gudgeons for easy mounting and removal.

Thus, there is a need for a system to produce high quality electrostatographic imaging members in higher yields by effectively removing dirt particles from cylindrical members used to treat or used as a component of devices such as coated or uncoated electrostatographic imaging members.

SUMMARY OF THE INVENTION

It is, therefore, an object of the present invention to provide an improved cleaning system which overcomes the above-noted deficiencies.

It is yet another object of the present invention to provide an improved cleaning system which removes dirt particles having a very small average particle size from the outer surfaces of cylinders.

It is still another object of the present invention to provide an improved cleaning system which can better identify dirt particle sources.

It is yet another object of the present invention to provide an improved cleaning system that prevents scratches from forming on a cylinder during cleaning.

The foregoing objects and others are accomplished in accordance with this invention by providing a system in which a contact cleaning cylinder is brought into moving synchronous contact with the surface of a cylindrical member to be cleaned to clean the surface.

BRIEF DESCRIPTION OF THE DRAWINGS

A more complete understanding of the process of the present invention can be obtained by reference to the accompanying drawings wherein.

The figures are merely schematic illustrations of the prior art and the present invention. They are not intended to indicate the relative size and dimensions of a contact cleaning system or components thereof.

DETAILED DESCRIPTION OF THE DRAWINGS

Figure 1:
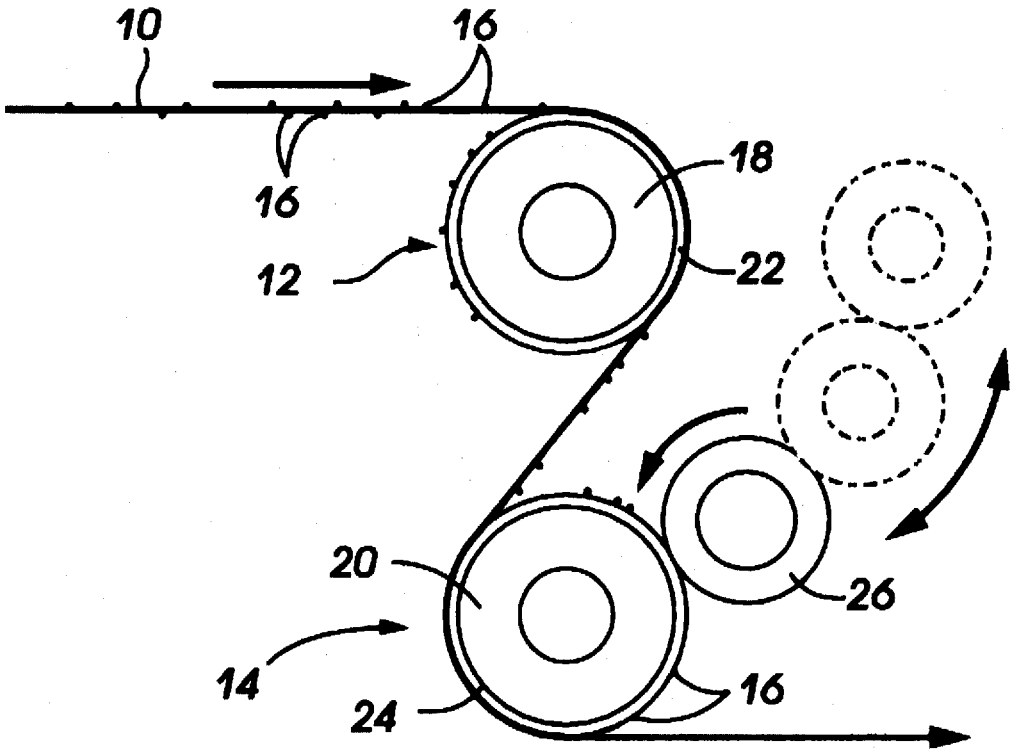
FIG. 1 is a schematic front elevation view of a cleaning system embodiment of this invention in which a contact cleaner roll is cleaned by a removable contact cleaning roll.

In FIG. 1, a moving electrostatographic imaging web substrate 10 is shown being cleaned through contact with contact cleaner rolls 12 and 14. In this embodiment, contact cleaner rolls 12 and 14 are mounted on a frame (not shown) to support and guide moving electrostatographic imaging web substrate 10. The direction of movement of electrostatographic imaging web substrate 10 is shown by the arrow. The incoming portion of electrostatographic imaging web substrate 10 is coated on both major surfaces with dirt particles 16. Contact cleaning roll 12 removes dirt particles 16 from one major surface of electrostatographic imaging web substrate 10 and contact cleaning roll 14 removes dirt particles 16 from the major surface on the opposite side of electrostatographic imaging web substrate 10. If desired, each of the contact cleaner rolls 12 and 14 may comprise an electrically conductive core 18 and 20 coated with an electrically insulating contact cleaning material 22 and 24. Some of the dirt particles 16 removed from electrostatographic imaging web substrate 10 are transferred to and accumulate on the outer surface of contact cleaner roll 14. The dirt particles 16 accumulated on the outer surface of contact cleaner roll 14 are removed by pivoting (by means not shown) another contact cleaning roll 26 against the outer surface of contact cleaner roll 14. The outer surface of contact cleaner roll 14 is in moving synchronous contact with the outer surface of contact cleaning roll 26. The axis of contact cleaner roll 14 is maintained parallel to the axis of contact cleaning roll 26 while contact cleaning roll 14 is being cleaned. Contact cleaning roll 14 may be cleaned continuously by maintaining contact between contact cleaner roll 14 and contact cleaning roll 26 or intermittently by swinging contact cleaner roll 26 away from contact cleaning roll 14 to the position shown by phantom lines.

Figure 2:
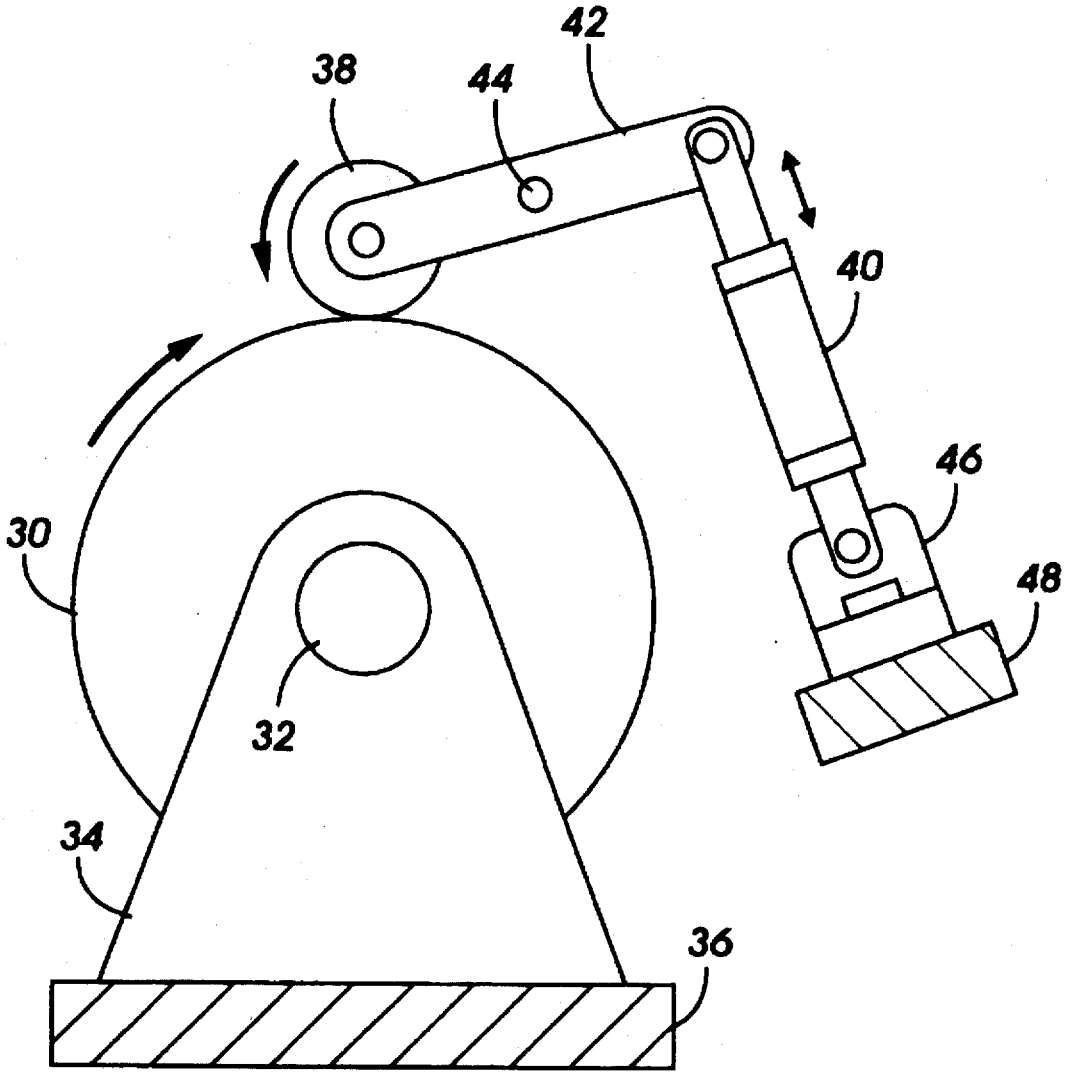
FIG. 2 is a schematic front elevation view of a cleaning system embodiment of this invention in which a large photoreceptor drum is cleaned by a removable contact cleaning roll.

In FIG. 2, a large diameter photoconductive drum 30 is illustrated. Drum 30 is mounted on an axial shaft 32 supported on flanges 34 (only one shown) for rotation by an electric motor (not shown). Flanges 34 are anchored to frame 36. Contact cleaning cylinder 38 may be brought into contact with or moved out of contact from drum 30 by activation or inactivation of two-way acting air cylinder 40. Activation of two-way acting air cylinder 40 which pivots arm 42 counterclockwise around pin 44 to move contact cleaning cylinder 38 downwardly into pressure contact with drum 30. Pin 44 is supported by a frame (not shown) and two-way acting air cylinder 40 is supported by flange 46 which is secured to the frame 48. Two-way acting cylinder 40 is activated and inactivated by a conventional air and valving source (not shown). Inactivation of two-way acting air cylinder 40 causes arm 42 to rotate clockwise to lift contact cleaning cylinder 38 away from 30 to facilitate removal of a cleaned drum and for the mounting of a fresh drum to be cleaned. The axis of drum 30 is parallel to the axis of contact cleaning cylinder 38. Cylinders, such as drum 30, that are cleaned by contact cleaning cylinder 38 may be selected from any suitable cylindrical member such as a transport roll, an electrostatographic imaging drum substrate, a coating applicator roll, a contact cleaning roll, a chill roll, a nip roll, backing roll, vacuum roll, and the like. Since contact cleaning cylinder 38 can be easily rejuvenated in place, it need not be taken out of service for rejuvenation. If desired, the positions of drum 30 and contact cleaning cylinder 38 can be reversed so that a contact cleaning cylinder can be mounted on axial shaft 32 and a cylinder to be cleaned can be supported on arm 42.

Generally, synchronous contact between the contact cleaning member and the surface to be cleaned is preferred to prevent any scrubbing action which can remove material of either the contact cleaning member or the surface to be cleaned. This prevents the formation of scratches on either the surface of contact cleaning member or the surface of the substrate to be cleaned. Synchronous speeds may be achieved by any suitable technique such as separate synchronized motor drives for the member being cleaned and the contact cleaning member. Alternatively, either the web being cleaned or the contact cleaning member can be driven by the other by frictional contact.

The contact cleaning surface may comprise a deposited coating on a supporting core member or it may make up the entire cleaning member. A soft conformable contact cleaning material at the surface of the cleaning roller is preferred to ensure greater surface area of contact between the contact cleaning surface and the dirt particles than between the dirt particles and the electrostatographic imaging web substrate. Thus, the durometer of the contact cleaning material is preferably less than the durometer of the materials of the cylindrical member to be cleaned.

There does not appear to be any criticality in the diameter of a contact cleaning roller. However, smaller diameter contact cleaning rolls have less surface available for accumulating dirt particles and tend to become overly dirty more rapidly. Moreover, a small diameter cleaning roll can bend if the roll is too long or if it comprises material that is too soft. It may be preferable to have the cleaning roll be a different diameter than the other rollers in the process to aid in troubleshooting repeat defects.

Any suitable tacky cleaning material may be used on the contact cleaning webs or rollers of this invention. Typical tacky cleaning materials include the medium tack materials utilized in "Post-it®" sheets available from the 3M Company. A square test sample having a width of about 5 centimeters of paper coated with medium tack materials such as employed in Post-it® type adhesives will stick to a human finger when the finger is pressed against the adhesive surface and thereafter lifted. These test samples will retain a dirt particle having an average particle size of between about 0.5 micrometer and about 100 micrometers when the test sample is pressed against the particle and lifted away from any smooth surface upon which the dirt particle originally rested. This test defines the expression "medium tack surface" as employed herein. Tacky materials employed in the medium tack coating are believed to contain tacky polymeric elastomeric alkyl acrylate or alkyl methacrylate ester material. Typical medium tack materials are disclosed, for example, in U.S. Pat. No. 4,994,322, the entire disclosure thereof being incorporated herein by reference.

The tacky rubber materials utilized in the contact cleaning members of this invention can have a low tack. The expression "low tack" as employed herein is defined as a tacky surface to which dirt particles having a size less than about 100 micrometers adhere, but to which a human finger does not adhere. Thus, a square test sample piece having a thickness of about 2 millimeters and a width of about 1 centimeter cannot be picked up when a human finger is pressed down against the sample and thereafter lifted. However, when the test sample is pressed against a dirt particle having an average particle size of between about 0.5 micrometer and about 100 micrometers, the dirt particle will adhere to the test sample when the test sample is lifted away from any smooth surface upon which the dirt particle originally rested. The low tack materials utilized in the contact cleaning roller of this invention may comprise any suitable adhesive material. Typical low tack materials include, for example, polyurethane, natural rubber, and the like. A typical low tack rubbery cross-linked polyurethane material is available from Polymag, Rochester, N.Y. and R. G. Egan, Rochester, N.Y. The low tack rubbery cross-linked polyurethane material has a durometer of about 15–35 Shore A. Low tack rubbery cross-linked polyurethane materials are described in U.S. Pat. No. 5,102,714 and U.S. Pat. No. 5,227,409, the entire disclosures thereof being incorporated herein by reference.

The amount of adhesion of the contact cleaning surface to the surface of any coated cylindrical substrates during contact cleaning should be less than the peel strength of the coating being cleaned to ensure that when the contact cleaning surface is separated from the surface being cleaned, the coating remains undamaged on the substrate. Since the peel strength of coatings on the substrate varies with the type of materials employed in the substrate and in coating, the amount of tack exerted by a contact cleaning member can vary depending upon the specific materials employed in substrate and coating. For example, a low tack contact polyurethane contact cleaning member surface is preferred for cleaning substrates vacuum coated with thin lightly held coatings. However, the amount of tackiness on a contact cleaning member surface should also be sufficient to remove particles having an average particle size between about 0.5 micrometer and about 100 micrometers when the contact cleaning surface is separated from the surface being cleaned.

Preferably, the color of the contact cleaning surface is different from the color of the dirt removed from the surface to be cleaned to provide contrast between the color of the dirt particles and the color of the contact cleaning surface. This facilitates determination of when the contact cleaning rolls should be cleaned or replaced and where the dirt particles are located on the contact cleaning surface.

Both the contact cleaning surface of the rolls of this invention and the cylindrical member to be cleaned should be sufficiently smooth to ensure contact between the contact cleaning surface and the dirt particles on the surface to be cleaned. Thus, the contact cleaning surface should be continuous. The contact cleaning surface should also not form any deposits on the surface of the cylindrical member to be cleaned because such deposits may adversely affect the electrical properties of the final electrostatographic imaging member.

A typical area of contact between the contact cleaning roll and the cylinder being cleaned is about 6 millimeters (¼ inch) measured along the direction of travel. The contact area will vary with the durometer of the rolls, the contact pressure, and the roll diameter. The area of contact can vary from 0.1 to 20 millimeters.

Large particles of dirt clinging to a contact cleaning member surface can emboss or even scratch a surface to be cleaned as the contact cleaning surface is cycled around a fresh surface to be cleaned. This can occur on a cycling contact cleaning roller. Thus, it is desirable that any large dirt particles have an average particle size of larger than about 100 micrometers be removed prior to bringing a contact cleaning surface into contact with the surface to be cleaned. Such removal of these relatively large particles also ensures that particles are not present to mask smaller underlying particles during subsequent contact cleaning. Any suitable technique such as air jet cleaning, vacuum cleaning, air impingement, ultrasonic resonation, and the like and combinations thereof may be utilized to remove particles having an average particles size greater than at least 100 micrometers.

Although a specific cleaning technique and apparatus are shown in the figures, any other suitable cleaning technique may be utilized to clean the contact cleaning members. The cleaning technique selected depends upon the type of dirt particles picked up by the cleaning member surfaces. Any liquid cleaning material utilized to clean off the contact cleaning member surface is preferably selected from materials that do not dissolve the dirt particles. Dissolving of the accumulated dirt particles can lead to absorption of the dirt into the surface of the contact cleaning member and can also lead to breakdown of the cleaning effectiveness of the contact cleaning surface. Satisfactory results have been achieved with cleaning materials comprising a mixture of water and alcohol. Typical alcohols include, for example, methanol, ethanol, isopropyl alcohol and the like. Generally, the mixture comprises between about 75 percent and about 99 percent by weight water and between about 1 percent and about 25 percent by weight alcohol. The preferred concentration comprises between about 78 and about 82 percent by weight water and between about 18 and about 22 percent alcohol.

When cleaning of the contact cleaning surface becomes less effective and where the thickness of the contact cleaning material is adequate, some of the surface of the contact cleaning surface may be ground or ablated away to remove any embedded dirt present and to also remove some of the ineffective contact cleaning material thereby exposing fresh contact cleaning material.

Preferably, cleaning and coating operations for fabricating electrostatographic imaging members are conducted under clean room conditions such as those at least meeting the requirements of a Class 1000 Clean Room. A Class 1000 Clean Room is defined as a room in which each one cubic foot volume of space does not have a particle count of more than 1000. If desired, more stringent clean room conditions may be utilized. However, for very large coating operations occupying a large volume of space, more stringent cleaning room conditions are more difficult and more expensive to achieve.

Electrostatographic flexible web imaging members are well known in the art. Typical electrostatographic flexible web imaging members include, for example, photoreceptors for electrophotographic imaging systems and electroceptors or ionographic members for electrographic imaging systems.

Electrostatographic flexible web imaging member may be prepared by various suitable techniques. Typically, a flexible web substrate is provided having an electrically conductive surface. For electrophotographic imaging members, at least one photoconductive layer is then applied to the electrically conductive surface. A charge blocking layer may be applied to the electrically conductive layer prior to the application of the photoconductive layer. If desired, an adhesive layer may be utilized between the charge blocking layer and the photoconductive layer. For multilayered photoreceptors, a charge generation binder layer is usually applied onto the blocking layer and charge transport layer is formed on the charge generation layer. For ionographic imaging members, an electrically insulating dielectric layer is applied to the electrically conductive surface.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. The electrically insulating or conductive substrate should be flexible and in the form of an endless flexible belt. Preferably, the endless flexible belt shaped substrate comprises a commercially available biaxially oriented polyester known as Mylar, available from E. I. du Pont de Nemours & Co. or Melinex available from ICI.

The thickness of the web substrate layer depends on numerous factors, including beam strength and economical considerations, and thus this layer for a flexible web may be of substantial thickness, for example, about 125 micrometers, or of minimum thickness less than 50 micrometers, provided there are no adverse effects on the final electrostatographic device. In one flexible web embodiment, the thickness of this layer ranges from about 65 micrometers to about 150 micrometers, and preferably from about 75 micrometers to about 100 micrometers for optimum flexibility and minimum stretch when cycled as a belt around small diameter rollers, e.g. 19 millimeter diameter rollers. The surface of the substrate layer is preferably cleaned prior to coating to produce higher quality coatings. Cleaning is preferably effected with the cleaning system of this invention.

The conductive layer may vary in thickness over substantially wide ranges depending on the optical transparency and degree of flexibility desired for the electrostatographic member. Accordingly, for a flexible photoresponsive web imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal or metal alloy layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. Typical vacuum depositing techniques include sputtering, magnetron sputtering, RF sputtering, and the like. Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer.

After formation of an electrically conductive surface, a hole blocking layer may be applied thereto for photoreceptors. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. Blocking layers are well known in the art and typical blocking layer materials are disclosed, for example, in U.S. Pat. Nos. 4,291,110, 4,338,387, 4,286,033 and 4,291,110, the disclosures of which are incorporated herein in their entirety. A preferred blocking layer comprises a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. The blocking layer should be continuous and have a thickness of less than about 0.2 micrometer because greater thicknesses may lead to undesirably high residual voltage.

An optional adhesive layer may applied to the hole blocking layer. Any suitable adhesive layer well known in the art may be utilized. Typical adhesive layer materials include, for example, polyesters, duPont 49,000 (available from E. I. dupont de Nemours and Company), Vitel PE100 (available from Goodyear Tire & Rubber), polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer may be applied to the adhesive blocking layer which can then be overcoated with a contiguous hole transport layer as described hereinafter. Typical photogenerating layer comprise inorganic or organic photoconductive pigment particles dispersed in a film forming binder as is well known in the art. Any suitable polymeric film forming binder material may be employed as the matrix in the photogenerating binding layer. Typical polymeric film forming materials include those described, for example, in U.S. Pat. No. 3,121,006, the entire disclosure of which is incorporated herein by reference.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and thereafter apply the photogenerating layer coating mixture. Typical application techniques include extrusion, spraying, dip coating, roll coating, wire wound rod coating, extrusion die coating, curtain coating, and the like. Drying of the deposited coating may be effected by any suitable conventional technique such as oven drying, infra red radiation drying, air drying and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in the multilayered photoconductor of this invention comprises from about 25 percent to about 75 percent by weight of at least one charge transporting aromatic amine compound, and about 75 percent to about 25 percent by weight of a polymeric film forming resin in which the aromatic amine is soluble.

Any suitable inactive resin binder soluble in a suitable solvent may be employed in the process of this invention and any suitable and conventional technique may be utilized to mix and thereafter apply the charge transport layer coating mixture to the charge generating layer. Typical application techniques include extrusion, spraying, dip coating, roll coating, wire wound rod coating, extrusion die coating, curtain coating, and the like. Drying of the deposited coating may be effected by any suitable conventional technique such as oven drying, infra red radiation drying, air drying and the like.

Generally, the thickness of the hole transport layer is between about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

Examples of photosensitive members having at least two electrically operative layers include the charge generator layer and diamine containing transport layer members disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507, the disclosures of these patents being incorporated herein in their entirety. The photoreceptors may comprise, for example, a charge generator layer sandwiched between a conductive surface and a charge transport layer as described above or a charge transport layer sandwiched between a conductive surface and a charge generator layer.

Other layers such as conventional electrically conductive ground strip along one edge of the belt in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

Optionally, an overcoat layer may also be utilized to improve resistance to abrasion. In some cases an anti-curl back coating may be applied to the side opposite the photoreceptor to provide flatness and/or abrasion resistance. These overcoating and anti-curl back coating layers are well known in the art and may comprise thermoplastic organic polymers or inorganic polymers that are electrically insulating or slightly semiconductive. Overcoatings are continuous and generally have a thickness of less than about 10 micrometers. The thickness of anti-curl backing layers should be sufficient to substantially balance the total forces of the layer or layers on the opposite side of the supporting substrate layer. A thickness between about 5 and about 50 micrometers is a satisfactory range for flexible web photoreceptors.

For electrographic imaging members, a flexible dielectric layer overlying the conductive layer may be substituted for the photoconductive layers. Any suitable, conventional, flexible, electrically insulating dielectric polymer may be used in the dielectric layer of the electrographic imaging member. If desired, the flexible belts of this invention may be used for other purposes where cycling durability is important.

Most of the coatings described above may also be applied to a cylindrical substrate to form a drum type electrostatographic imaging member.

As described above, any suitable cylindrical member may be cleaned with the contact cleaning cylinder of the cleaning system of this invention. Typical cylindrical members that may be may be cleaned include, for example, electrostatographic drum substrates, transport rolls, drive rolls, idler rolls, rubber nip rolls, vacuum rolls, chill rolls, coating applicator rolls, cleaning rolls and the like.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A cylindrical member was selected for cleaning. This smooth outer surface of this cylindrical member consisted of dynamically balanced hard coat anodized aluminum with an 8 to 12 micro finish. The cylindrical member had a diameter of 10 centimeters and a length of 122 centimeters. The outer surface of the cylindrical member carried dirt particles having an average size greater than 0.5 micrometers and less than about 100 micrometers. After mounting in the process line, the cylindrical member was rotated at 70 revolutions per minute by the moving web. The outer surface of a freely rotatable contact cleaning roll was then brought into contact with the outer surface of the rotating cylindrical member. The contact cleaning roll comprised a metal core around which was molded a polyurethane rubber layer having a thickness of 13 millimeters. The polyurethane rubber layer was a low tack rubbery cross-linked polyurethane material having a durometer of about 22 Shore A and is available from R. G. Egan, Rochester, N.Y. The contacting surface of the contact cleaning roll was synchronized with the speed of the outer surface of the rotating cylindrical member to avoid slippage between the cylindrical member and the contacting surface of the contact cleaning rolls. The contact cleaning roll had a diameter of 10 centimeters and a length of 30 centimeters. The axis of the contact cleaning roll was maintained parallel with the axis of the cylindrical member during contact cleaning. After 700 revolutions the outer surfaces of the cylindrical member and the contact cleaning roll were examined with the aid of an ultraviolet light and an inverted microscope. The surface of the cylindrical member was free of dirt particles having an average size greater than 0.5 micrometers and less than about 100 micrometers whereas dirt particles having an average size greater than 0.5 micrometers and less than about 100 micrometers were found on the surface of the contact cleaning member.

EXAMPLE II

A cylindrical member was selected for use as a cleaning tool to clean another cleaning roll. The smooth outer surface of this cylindrical member consisted of a compliant urethane with a durometer of 19 shore A having a higher tack than the cleaning roll in example I. The cylindrical member had a diameter of 10 centimeters and a length of 76 centimeters. The outer surface of the cylindrical member carried dirt particles having an average size greater than 0.5 micrometers and less than about 100 micrometers. After mounting in the process line, the cylindrical member was rotated at 70 revolutions per minute by the moving web. The outer surface of a freely rotatable contact cleaning roll was then brought into contact with the outer surface of the rotating cylindrical member. The contact cleaning roll comprised a metal core around which was molded a polyurethane rubber layer having a thickness of 13 millimeters. The polyurethane rubber layer was a low tack rubbery cross-linked polyurethane material having a durometer of about 22 Shore A and is available from R. G. Egan, Rochester, N.Y. The contacting surface of the contact cleaning roll was synchronized with the speed of the outer surface of the rotating cylindrical member to avoid slippage between the cylindrical member and the contacting surface of the contact cleaning rolls. The contact cleaning roll had a diameter of 10 centimeters and a length of 30 centimeters. The axis of the contact cleaning roll was maintained parallel with the axis of the cylindrical member during contact cleaning. After 350 revolutions the outer surfaces of the cylindrical member and the contact cleaning roll were examined with the aid of an ultraviolet light and an inverted microscope. The surface of the cleaning roll was free of dirt particles having an average size greater than 0.5 micrometers and less than about 100 micrometers whereas dirt particles having an average size greater than 0.5 micrometers and less than about 100 micrometers were found on the surface of the cylindrical member. Particles in excess of 100 micrometers were not consistently removed from the cleaning roll.

EXAMPLE III

A cylindrical member was selected for cleaning. This smooth outer surface of this cylindrical member consisted of mirror finish aluminum. The cylindrical member had a diameter of 8 centimeters and a length of 100 centimeters. The outer surface of the cylindrical member carried dirt particles having an average size greater than 0.5 micrometers and less than about 100 micrometers. After mounting in fixture with a motor drive, the cylindrical member was rotated at 20 revolutions per minute. The outer surface of a freely rotatable contact cleaning roll was then brought into contact with the outer surface of the rotating cylindrical member. The contact cleaning roll comprised a metal core around which was molded a polyurethane rubber layer having a thickness of 13 millimeters. The polyurethane rubber layer was a low tack rubbery cross-linked polyurethane material having a durometer of about 22 Shore A and is available from R. G. Egan, Rochester, N.Y. The contacting surface of the contact cleaning roll was synchronized with the speed of the outer surface of the rotating cylindrical member to avoid slippage between the cylindrical member and the contacting surface of the contact cleaning rolls. The contact cleaning roll had a diameter of 10 centimeters and a length of 30 centimeters. The axis of the contact cleaning roll was maintained parallel with the axis of the cylindrical member during contact cleaning. After 2 revolutions the outer surfaces of the cylindrical member and the contact cleaning roll were examined with the aid of an ultraviolet light and an inverted microscope. The surface of the cylindrical member was free dirt particles having an average size greater than 0.5 micrometers and less than about 100 micrometers whereas dirt particles having an average size greater than 0.5 micrometers and less than about 100 micrometers were found on the surface of the contact cleaning member.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. Apparatus comprising:

a frame, a rotatable photoreceptor drum supported by said frame, said rotatable photoreceptor drum having a movable outer surface to be cleaned, and a movable cylindrical contact cleaner adjacent to said rotatable photoreceptor drum, said movable cylindrical contact cleaner having a tacky outer surface disposed for synchronous moving contact with and cleaning of said movable outer surface of said rotatable photoreceptor drum when said movable outer surface of said rotatable photoreceptor drum is moved, said tacky outer surface of said movable cylindrical contact cleaner being more tacky than said movable outer surface of said rotatable photoreceptor drum.

2. Apparatus according to claim 1 wherein said movable cylindrical contact cleaner and said rotatable photoreceptor drum each have an outer circumference, the outer circumference of said movable cylindrical contact cleaner being between about 10 and about 1000 percent of the outer circumference of said rotatable photoreceptor drum.

3. Apparatus according to claim 1 wherein said rotatable photoreceptor drum is a photoreceptor drum substrate.

4. Apparatus according to claim 1 wherein said movable outer surface of said rotatable photoreceptor drum carries dirt particles having a particle size between about 0.5 micrometer and about 100 micrometers which transfer to said tacky outer surface of said movable cylindrical contact when said tacky outer surface of said movable cylindrical contacts said movable outer surface of said rotatable photoreceptor drum during said synchronous moving contact with and cleaning of said movable outer surface of said rotatable photoreceptor drum.

5. Apparatus according to claim 1 including a pivotable arm device to bring said rotatable photoreceptor drum into contact with said movable cylindrical contact cleaner.

6. Apparatus according to claim 1 including a pivotable arm device to bring said movable cylindrical contact cleaner into contact with said rotatable photoreceptor drum.

7. Apparatus comprising:

a frame, a rotatable cylindrical member supported by said frame, said cylindrical member having a tacky movable outer surface, a web to be cleaned having an outer surface in contact with said tacky movable outer surface of said rotatable cylindrical member, and a movable cylindrical contact cleaner adjacent to said rotatable cylindrical member, said movable cylindrical contact cleaner having a tacky outer surface disposed for synchronous moving contact with and cleaning of said tacky movable outer surface of said rotatable cylindrical member when said tacky movable outer surface of said rotatable cylindrical member is moved, said tacky movable outer surface of said movable cylindrical contact cleaner being more tacky than said tacky movable outer surface of said rotatable cylindrical member.

8. Apparatus according to claim 7 wherein said web to be cleaned is a photoreceptor web substrate.

9. Apparatus according to claim 7 wherein said web to be cleaned is a photoreceptor web substrate having at least one coating.

10. Apparatus according to claim 7 wherein said outer surface of said web to be cleaned carries dirt particles having a particle size between about 0.5 micrometer and about 100 micrometers which transfer to said tacky movable outer surface of said rotatable cylindrical member when said web to be cleaned contacts said tacky movable outer surface of said rotatable cylindrical member.

* * * * *